US006430969B1

(12) United States Patent
Roell

(10) Patent No.: US 6,430,969 B1
(45) Date of Patent: Aug. 13, 2002

(54) DEVICE FOR SECURING A TWO-LAYERED KNITTED FABRIC TO A SUPPORT

(75) Inventor: Friedrich Roell, Biberach (DE)

(73) Assignees: Stefan Achter, Moenchengladbach; Dr. Viktor Nikolaus Achter, Cologne, both of (DE)

( * ) Notice: Subject to any disclaimer, the term of this patent is extended or adjusted under 35 U.S.C. 154(b) by 0 days.

(21) Appl. No.: 09/807,194

(22) PCT Filed: Sep. 17, 1999

(86) PCT No.: PCT/DE99/03052

§ 371 (c)(1),
(2), (4) Date: Jun. 29, 2001

(87) PCT Pub. No.: WO00/22214

PCT Pub. Date: Apr. 20, 2000

(30) Foreign Application Priority Data

Oct. 9, 1998 (DE) ..... 198 47 334

(51) Int. Cl.[7] ..... D04B 1/22
(52) U.S. Cl. ..... 66/170; 66/190; 66/196
(58) Field of Search ..... 66/170, 177, 198, 66/60 R, 64, 183, 184, 174, 190, 178 R, 196; 297/218.1, 218.2, 218.3, 218.4, 218.5

(56) References Cited

U.S. PATENT DOCUMENTS 5,457,968 A 10/1995 McClintock
5,887,452 A * 3/1999 Smith et al. ..... 66/170
5,890,381 A * 4/1999 Leeke et al. ..... 66/170
5,992,185 A * 11/1999 Leeke et al. ..... 66/170
6,151,926 A * 11/2000 Leeke et al. ..... 66/170

FOREIGN PATENT DOCUMENTS

| | | |
|---|---|---|
| DE | 86 29 570 | 12/1986 |
| EP | 0 734 670 | 10/1996 |
| EP | 0 897 029 | 2/1999 |
| WO | 91/00936 | 1/1991 |
| WO | 94/26655 | 11/1994 |

* cited by examiner

*Primary Examiner*—Danny Worrell
(74) *Attorney, Agent, or Firm*—Smith-Hill and Bedell

(57) ABSTRACT

The invention relates to an arrangement for securing a two-layered knitted fabric to a support such as one required to secure seat covers to supports. A first fastening element (14) is placed between the two layers (12, 13) of the knitted fabric while a second fastening element is placed on or in the support. A connecting element is stretched between the first and second fastening element, whereby the first end of said connecting element can be fixed onto the first fastening element and the second end can be fixed onto the second fastening element. The inventive arrangement enables a cover to be fixed onto a support in a quick and effective manner without manufacturing said cover by approaching fastening elements at low machine running times.

16 Claims, 2 Drawing Sheets

DEVICE FOR SECURING A TWO-LAYERED KNITTED FABRIC TO A SUPPORT

Figure 1:
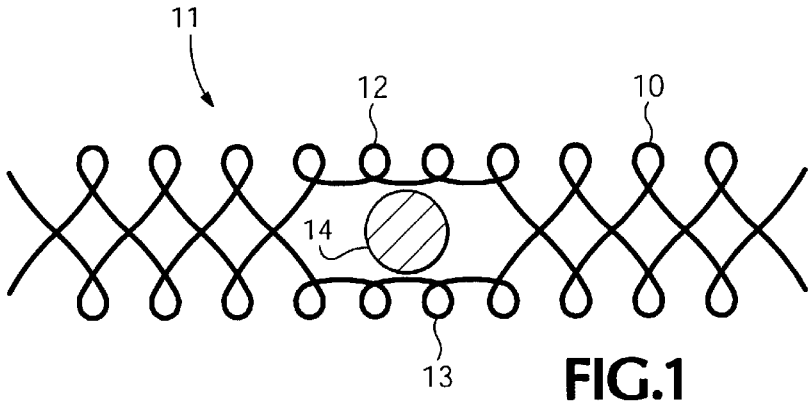

The present invention relates to a device for securing a two-layered knitted fabric to a support, for example a device used to secure a seat cover to a seat frame.

In the automobile industry the trend in automotive seat manufacturing is to no longer weave the seat covers and assemble them in a relatively labor-intensive process, but rather to manufacture them in finished form directly on a flat-bed knitting machine as a three-dimensional knitted fabric, so that no further assembly is needed. When the seat cover is manufactured on the knitting machine, it is of course desirable to knit the seat cover fastening areas that are used to secure the seat cover to the seat frame at the same time as the cover itself, so that no additional assembly work is required for the fasteners. One way to achieve this objective is recited in EP 0 484 370 A1, in which tubular sections are knitted on during the process in which the seat cover is knitted, without the need for a separate assembly step. However, such knitted-on parts substantially lengthen the machine operating times for the individual seat cover, since the rest of the cover cannot be knitted during the time these parts are being knitted. Of course, such seat covers are also suitable for freestanding furniture in offices or residences, in other words for stationary seating applications.

The object of the invention is to create a device for securing a two-layered knitted fabric to a support wherein said device permits the knitted fabric to be easily secured to the support without a substantial increase in the time and effort needed to manufacture the seat cover. This object is accomplished by the elements of claim 1. Preferred embodiments of the invention are recited in the dependent claims.

In the invention, a fastener that is used to secure the seat cover to the support is pulled in between the two layers of the seat cover. This fastener may, for example, be a welt or a hollow profile into which one end of a connector or fastener engages, while the other end of said connector or fastener is provided on or can be secured on the support. Said first fastener must always be more rigid than the knitted fabric itself so that it can thereby hold the knitted fabric flatter against the support. For example, the welt can be a relatively rigid plastic rod; however, it may also be embodied as a somewhat more rigid wire or a plastic cord in any given shape that can be inserted into an elongated pocket.

Second fasteners are disposed in or on the support. Said second fasteners either interact directly with the first fasteners, or the other end of the fastener engages them. The second fasteners may also be embodied as hollow profiles, eyes, hooks, holes, hook-and-loop fastener structures, magnets, clips, etc. Said fastener is preferably embodied as an elastic tape or cord between the knitted fabric and the support, so that the first fastener on the knitted fabric does not need to be positioned directly above the second in fastener on the support. Fastening can also be accomplished here if said fasteners are located somewhat far apart.[1] Such spatial imprecision, which can always occur when a seat cover is being manufactured, is compensated for by the flexibility of the fastener.

[1]Translator's note: The German word "beanstandet" (meaning: to complain about something) that appears in this sentence is an obvious typographical error for "beabstandetet", which means to space or locate objects at a distance from one another.

Both the first and the second fasteners preferably have an elongated configuration, thus permitting the fastener to be secured in the longitudinal direction. If the first and second fasteners continue to extend perpendicular to one another, there will still be some points at which the first fastener is located directly above the second fastener. Such points can be used to position fasteners. However, the fastener can also be embodied as a flexible but not elastic textile tape or textile cord, rubber band, woven tape, nonwoven fabric tape, or plastic tape, and perhaps a wire cord as well. Coil springs can also be used as the fasteners. The elastic fastener can be integrated directly on/in the first fastener on the knitted fabric or on/in the second fastener on the support.

The securing device of the invention is not merely suitable for fastening seat covers to seat frames; it is also suitable for fastening textile trim parts, design structures, insulation and filter parts to supports, for example in automotive interior applications.

The first and/or second fastener can also be embodied as a ferromagnetic material or magnet that interacts with the other complementary fastener (magnet, other pole/ferromagnetic material).

The elongated pocket formed by the two layers of fabric, which is used to insert the first fastener, may at some locations possess openings or perforations facing the support that can be used for fastening to the second fastener on the support or to a connector in the vicinity of said openings. Such openings also facilitate inserting the first fastener itself into the pocket.

In addition to securing the knitted fabric to the support by means of the fasteners, Velcro structures (hook-and-loop closures) can be provided to support the securing of the cover-for example in the area of curves or highly contoured parts in order to achieve a smooth, wrinkle-free design appearance at such locations.

Even though said joining technology cannot always be used due to the difficulty of solving the problems associated with it, the first and second fasteners can also be embodied as adhesive bonding sites that are joined to one another by applying an adhesive.

Figure 2:
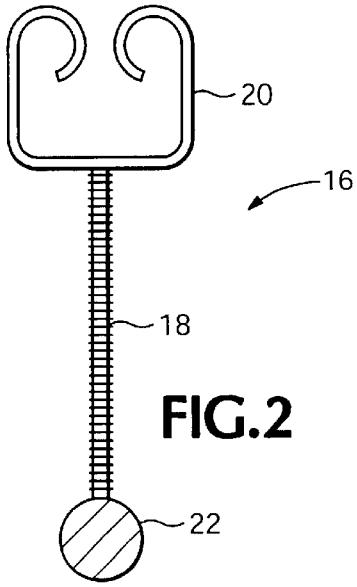
Figure 3:
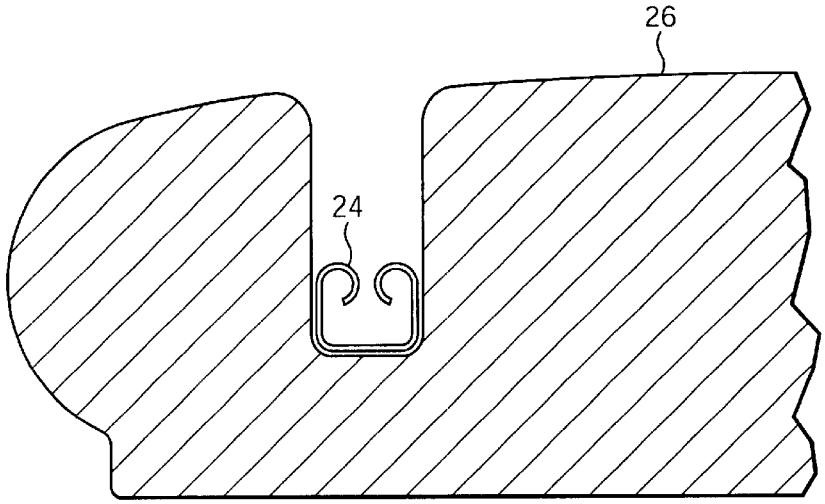
Figure 4:
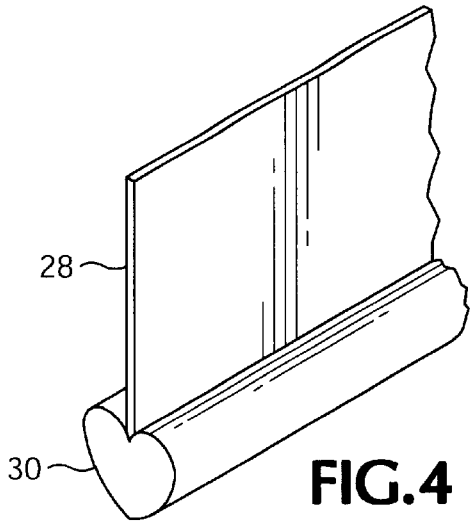
Figure 5:
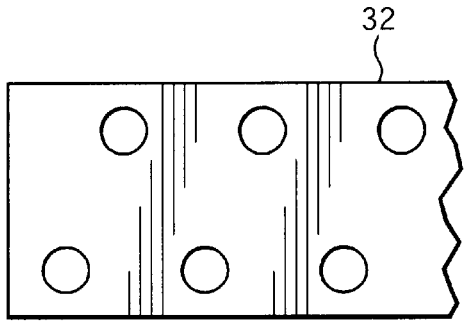
Figure 6:
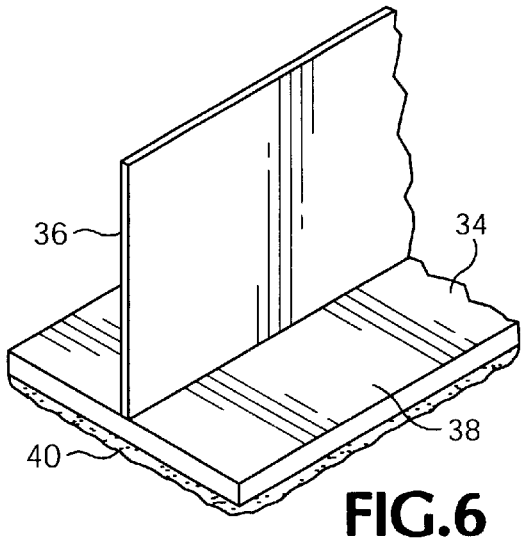

The invention will be described below by way of example based on the schematic diagram. The diagram shows:

FIG. 1 A cross-sectional view through a two-layered knitted fabric having a welt inserted as a fastener, FIG. 2 a fastener for securing the double-layered knitted fabric of FIG. 1 to a support shown in FIG. 3, FIG. 3 a support having a fastener for engaging a connector, FIGS. 4–6 three further embodiments of connectors for engaging the fasteners on the double-layer knitted fabric and on the support.

FIG. 1 shows a two-layer knitted fabric, for example a double jersey structure, which is generally knitted with an 1×1 rib. In one area, 11, the two layers 12, 13 of the double jersey are not knitted together, so that a cavity is formed between the two layers 12, 13. A welt 14 is inserted in said cavity to form a first fastener. Said welt is much more rigid than the surrounding fabric. Said welt passes through a specified length of the double-layer knitted fabric, and it can be engaged at any given position along its length by a fastener shown in FIG. 2. The connector 16 contains an elastic tape 18 on whose upper end a first engaging means 20 is disposed. Said engaging means is configured in this case in the form of a c-shaped hollow profile, and its function is to grasp the welt 14 in the double-layer knitted fabric 10. The other end 22 of the fastener 16 is also embodied as a welt in which [subject of relative clause is missing—translator[2]] can be secured in a second fastener 24 on a support 26. The second fastener 24 is therefore embodied here as a c-shaped hollow profile that is identical here to the first fastener 20 on the first connector 16. The welt 22, functioning as the second engaging means of connector 16, is simply pressed into the c-shaped profile 24 of the support and is thus secured in this fashion. The second fastener 24 on the support 26 has a larger longitudinal dimension extending outward from the plane of the drawing. The first and second fasteners 14, 24, preferably cross one another, so that connectors 16 can be provided at all crossing points in order to secure the knitted fabric 10 to the support 26. The length of the connectors 16 should approximately correspond to the distance between the first and second fasteners at the crossing points. The elastic connectors should be somewhat shorter in order to hold the seat cover slightly taut against the support.

[2]Translator's note: The correct wording should probably be "which" instead of "in which." The gender of the relative pronoun would then agree with welt ["Keder"] and no other possible antecedent in the sentence.

FIG. 4 shows another embodiment of a connector 28. An engaging means 30 is embodied as a heart-shaped profile. Said engaging means can easily be inserted into a hollow profile-shaped fastener on the support and/or on the double-layer knitted fabric, but, because of its shape, said engaging means is difficult to remove.

Here, it must be noted that the first and second fastener can, of course, have the same profile, or the fasteners and engaging means shown in FIGS. 1–3 can be embodied in such a way that they are identical to each other. FIG. 5 shows a connector 32 embodied as a rubber band having perforations on its upper and lower terminal areas. Said perforations can have corresponding structures on the first and second fasteners passing through them.

A further alternative embodiment of a connector 34 is shown in FIG. 6. Here, on at least one end of the connector 34, a fastening surface 38 is provided perpendicular to a rubber band 36 on the connector that compensates for the distance between the two-layered knitted fabric and the support. A hook-and-loop closure structure 40 is provided on their outer side facing the rubber band. Said hook-and-loop closure structure engages a complementary hook-and-loop closure structure on the support or in the space between the two layers of the knitted fabric.

Of course, the types of engaging means described above can also be combined with one another in any desired manner. The area of the connectors between the two engaging means (see for example 18 in FIG. 2) is preferably elastic, so that points that are not located directly above one another can nonetheless be connected. In this fashion, seat covers that have relatively large ranges of tolerances can be secured to the support without difficulty.

What is claimed is:

1. A device for securing a web of a two-layer knitted fabric to a support, wherein the web of knitted fabric has an inner layer presented towards the support and an outer layer presented away from the support, the device comprises a first fastener element provided between the inner and outer layers of the knitted fabric and a second fastener element secured to the support and to which the first fastener element can be secured, and the inner and outer layers of the web are substantially identical at the location of the first fastener element.

2. The device of claim 1, comprising a connector having first and second opposite ends secured to the first and second fastener elements respectively, the connector being under tension between the first and second fastener elements.

3. The device of claim 2, wherein the connector is provided at its first end with a first engaging means that is complementary to the first fastener element and is provided at its second end with a second engaging means that is complementary to the second fastener element.

4. The device of claim 2, wherein the connector is elastic.

5. The device of claim 4, wherein the connector is a rubber band, a rubber cord, or a coil spring.

6. The device of claim 2, wherein the first end of the connector has a first portion of a hook-and-loop fastening structure that interacts with a complementary second portion of the hook-and-loop fastening structure on the first fastener element.

7. The device of claim 2, wherein the second end of the connector has a first portion of a hook-and-loop fastening structure that interacts with a complementary second portion of the hook-and-loop fastening structure on the second fastener element.

8. The device of claim 1, wherein the first or second fastener element is elongated, so that fastening can take place at various points along the fastener element.

9. The device of claim 8, wherein the first fastener element is a partially flexible welt or rod.

10. The device of claim 8, wherein the second fastener element is a c-shaped profile part.

11. The device of claim 10, wherein the support has a cover side and the c-shaped profile part has an opening and is foam-molded in the support in such a way that the opening is towards the cover side of the support.

12. The device of claim 1, wherein the web of two-layer knitted fabric includes a portion in which the two layers are not connected to each other across at least two rows of loops, and the first fastener element is located in said portion of the web.

13. The device of claim 1, wherein the first fastener is provided with a first portion of a hook-and-loop fastening structure that interacts with a complementary second portion of the hook-and-loop fastening structure on the second fastener.

14. The device of claim 1, wherein the first and second fasteners are elongated and extend perpendicular to each other.

15. The device of claim 1, wherein the knitted fabric and the support have complementary hook-and-loop fastener structures in contoured areas.

16. A seat comprising a seat cover, a seat cover support, and a device for securing the seat cover to the support, wherein the seat cover comprises a web of a two-layer knitted fabric having an inner layer presented towards the support and an outer layer presented away from the support, the device comprises a first fastener element provided between the inner and outer layers of the knitted fabric and a second fastener element secured to the support and to which the first fastener element can be secured, and the inner and outer layers of the web are substantially identical at the location of the first fastener element.

* * * * *